US010847082B2

(12) United States Patent
Kim

(10) Patent No.: US 10,847,082 B2
(45) Date of Patent: Nov. 24, 2020

(54) GATE DRIVING CIRCUIT HAVING A PLURALITY OF GATE DRIVING CIRCUIT BLOCKS, DISPLAY DEVICE INCLUDING THE SAME, AND DRIVING METHOD THEREOF

(71) Applicant: Samsung Display Co., Ltd., Yongin-si (KR)

(72) Inventor: Jong Hee Kim, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/366,553

(22) Filed: Mar. 27, 2019

(65) Prior Publication Data

US 2020/0066203 A1 Feb. 27, 2020

(30) Foreign Application Priority Data

Aug. 23, 2018 (KR) ..... 10-2018-0098544

(51) Int. Cl.
*G09G 5/00* (2006.01)
*G09G 3/32* (2016.01)

(52) U.S. Cl.
CPC ..... *G09G 3/32* (2013.01); *G09G 2310/0278* (2013.01); *G09G 2330/026* (2013.01); *G09G 2330/06* (2013.01)

(58) Field of Classification Search
CPC ..... G09F 3/32; G09G 2310/0278; G09G 2330/026; G09G 2330/06
USPC ..... 345/211
See application file for complete search history.

(56) References Cited

U.S. PATENT DOCUMENTS 9,293,093 B2 3/2016 Kim et al.
9,524,690 B2 12/2016 Lim et al.
9,830,845 B2 11/2017 Lim et al.
9,830,856 B2 11/2017 Kwon et al.
(Continued)

FOREIGN PATENT DOCUMENTS

KR 10-1055206 B1 8/2011
KR 10-1319356 B1 10/2013
(Continued)

OTHER PUBLICATIONS

Shin et al., "A Novel OLED Display Panel with High-Reliability Integrated Gate Driver Circuit using IGZO TFTs for Large-Sized UHD TVs"; SID 2018 Digest, pp. 358-361.

*Primary Examiner* — Jonathan M Blancha
(74) *Attorney, Agent, or Firm* — Lewis Roca Rothgerber Christie LLP

(57) ABSTRACT

A display device includes a gate driver for applying scan signals and including a plurality of gate driving circuit blocks, and a data driver for applying a data voltage to data lines, wherein the gate driving circuit blocks respectively output a carry signal to be transmitted to a first input terminal of a subsequent gate driving circuit block based on a signal applied to a first control node through a first input terminal and a carry clock signal input to a carry clock input terminal, output a scan signal to a first scan line based on the signal applied to the first control node and a scan clock signal input to a first scan clock input terminal, and output a scan signal to a second scan line based on the signal applied to the first control node and a scan clock signal input to a second scan clock input terminal.

19 Claims, 6 Drawing Sheets

(56) References Cited

U.S. PATENT DOCUMENTS

| | | | | |
|---|---|---|---|---|
| 9,837,036 | B2 | 12/2017 | Amino et al. | |
| 9,842,557 | B2 | 12/2017 | Kim et al. | |
| 9,875,710 | B2 | 1/2018 | Kim et al. | |
| 2015/0317954 | A1* | 11/2015 | Jang | G11C 19/28 345/213 |
| 2016/0203762 | A1 | 7/2016 | Kim et al. | |
| 2017/0004760 | A1* | 1/2017 | Jang | G09G 3/2092 |
| 2019/0043405 | A1* | 2/2019 | Noh | G09G 3/3674 |

FOREIGN PATENT DOCUMENTS

| | | | |
|---|---|---|---|
| KR | 10-2015-0017810 | A | 2/2015 |
| KR | 10-2015-0107937 | A | 9/2015 |
| KR | 10-2015-0115105 | A | 10/2015 |
| KR | 10-2015-0142708 | A | 12/2015 |
| KR | 10-2016-0087951 | A | 7/2016 |
| KR | 10-2016-0087952 | A | 7/2016 |
| KR | 10-2016-0089937 | A | 7/2016 |
| KR | 10-2016-0092584 | A | 8/2016 |
| KR | 10-2016-0100084 | A | 8/2016 |
| KR | 10-2017-0014072 | A | 2/2017 |
| KR | 10-2017-0109745 | A | 10/2017 |
| KR | 10-2017-0115183 | A | 10/2017 |
| KR | 10-1859471 | B1 | 5/2018 |

* cited by examiner

GATE DRIVING CIRCUIT HAVING A PLURALITY OF GATE DRIVING CIRCUIT BLOCKS, DISPLAY DEVICE INCLUDING THE SAME, AND DRIVING METHOD THEREOF

CROSS-REFERENCE TO RELATED APPLICATION

This application claims priority to, and the benefit of, Korean Patent Application No. 10-2018-0098544 filed in the Korean Intellectual Property Office on Aug. 23, 2018, the entire contents of which are incorporated herein by reference.

BACKGROUND

1. Field

Embodiments of the present disclosure relate to a gate driving circuit for driving a plurality of gate lines, a display device including the same, and a method for driving a display device.

2. Description of the Related Art

When a thin film transistor provided in a display area of a display device is manufactured, an amorphous silicon gate (ASG) technique for concurrently or simultaneously forming a gate driving circuit in a peripheral area of the display device may be applied. As a plurality of gate driving circuits are formed in the peripheral area of the display device, there is no need to use an additional gate driving chip, and a cost for manufacturing the display device may be reduced.

Recently, techniques for reducing a dead space in which no image is displayed in the display device have been under development The peripheral area may be reduced to reduce the dead space of the display device. Each of a plurality of gate driving circuits may be formed on one pixel row (or a scan line). That is, there may be a plurality of gate driving circuits prepared at each of the pixel rows (or at each of the scan lines). The presence of the gate driving circuits may limit the degree to which the peripheral area of the display device may be reduced. That is, there may be a limitation in reducing the dead space of the display device.

To reduce the dead space of the display device, a region occupied by a plurality of gate driving circuits may be reduced. An area occupied by a transistor or a capacitor included in the gate driving circuit may be reduced so as to reduce the region occupied by a plurality of gate driving circuits. In this case, the gate driving circuit may be weak against noise (e.g., signal interference).

The above information disclosed in this Background section is only for enhancement of understanding of the background of the present disclosure, and therefore may contain information that does not form the prior art that is already known in this country to a person of ordinary skill in the art.

SUMMARY

Embodiments of the present disclosure provide a gate driving circuit for reducing a dead space of a display device that is also strong against noise, and a display device including the same.

An embodiment of the present disclosure provides a display device including a plurality of pixels, a gate driver for applying a scan signal to a plurality of scan lines connected to the pixels, and including a plurality of gate driving circuit blocks, and a data driver for applying a data voltage to a plurality of data lines connected to the pixels, wherein the gate driving circuit blocks respectively output a carry signal to be transmitted to a first input terminal of a subsequent gate driving circuit block at a next stage based on both a signal applied to a first control node through a first input terminal and a carry clock signal input to a carry clock input terminal, output a first scan signal to a first scan line based on both the signal applied to the first control node and a first scan clock signal input to a first scan clock input terminal, and output a second scan signal to a second scan line based on the signal applied to the first control node and a second scan clock signal input to a second scan clock input terminal.

A voltage level of the carry clock signal may be different from a voltage level of a first scan clock signal input to the first scan clock input terminal and may be different from a voltage level of a second scan clock signal input to the second scan clock input terminal.

The gate driving circuit blocks may be respectively configured to bootstrap a voltage of the signal applied to the first control node through the first input terminal by using a first scan clock signal input to the first scan clock input terminal, and to bootstrap the voltage of the signal applied to the first control node through the first input terminal by using a second scan clock signal input to the second scan clock input terminal.

The gate driving circuit blocks may be respectively configured to not bootstrap a voltage at the first control node with the carry clock signal, and may be configured to output the carry clock signal as the carry signal.

The carry clock signal may be configured to be applied as an on voltage while a voltage at a first node is bootstrapped.

The gate driver may be configured to apply a sensing signal for measuring a current flowing to the pixels to a sensing line connected to the pixels, and wherein the gate driving circuit blocks may be respectively configured to output a sensing signal to a first sensing line based on a sensing clock signal input to a first sensing clock input terminal, and to output a sensing signal to a second sensing line based on a sensing clock signal input to a second sensing clock input terminal.

The gate driving circuit blocks may be respectively configured to bootstrap a voltage of the signal applied to the first control node through the first input terminal by using a first sensing clock signal input to the first sensing clock input terminal, and to bootstrap the voltage of the signal applied to the first control node through the first input terminal by using a second sensing clock signal input to the second sensing clock input terminal.

An entire number of scan clock signals and sensing clock signals used in an operation of the gate driver may correspond to a value of a product of a number of scan signals and sensing signals output by the gate driving circuit blocks and an entire number of carry clock signals used in an operation of the gate driver.

A number of the gate driving circuit blocks may be half a number of the scan lines.

Another embodiment of the present disclosure provides a gate driving circuit including a carry signal output unit for outputting a carry signal to be transmitted to a first input terminal of a subsequent gate driving circuit at a next stage based on both a signal applied to a first control node through a first input terminal and a carry clock signal input to a carry clock input terminal, a first scan signal output unit for outputting a first scan signal to a first scan line based on both the signal applied to the first control node and a first scan clock signal input to a first scan clock input terminal, and a second scan signal output unit for outputting a second scan signal to a second scan line based on both the signal applied to the first control node and a second scan clock signal input to a second scan clock input terminal.

The first scan signal output unit may include a first pull-up transistor including a gate electrode connected to the first control node, a first electrode connected to the first scan clock input terminal, and a second electrode connected to a first scan output terminal connected to the first scan line, and a first capacitor including a first electrode connected to the first control node and a second electrode connected to the first scan output terminal.

The second scan signal output unit may include a third pull-up transistor including a gate electrode connected to the first control node, a first electrode connected to the second scan clock input terminal, and a second electrode connected to a second scan output terminal connected to the second scan line, and a third capacitor including a first electrode connected to the first control node and a second electrode connected to the second scan output terminal.

The carry signal output unit may include a fifth pull-up transistor including a gate electrode connected to the first control node, a first electrode connected to the carry clock input terminal, and a second electrode connected to a carry output terminal connected to a first input terminal of the subsequent gate driving circuit at the next stage.

The gate driving circuit may further include a first sensing signal output unit for outputting a first sensing signal to a first sensing line based on the signal applied to the first control node and a first sensing clock signal input to a first sensing clock input terminal, and a second sensing signal output unit for outputting a second sensing signal to a second sensing line based on the signal applied to the first control node and a second sensing clock signal input to a second sensing clock input terminal.

The first sensing signal output unit may include a second pull-up transistor including a gate electrode connected to the first control node, a first electrode connected to the first sensing clock input terminal, and a second electrode connected to a first sensing output terminal connected to the first sensing line, and a second capacitor including a first electrode connected to the first control node, and a second electrode connected to the first sensing output terminal.

The second sensing signal output unit may include a fourth pull-up transistor including a gate electrode connected to the first control node, a first electrode connected to the second sensing clock input terminal, and a second electrode connected to a second sensing output terminal connected to the second sensing line, and a fourth capacitor including a first electrode connected to the first control node, and a second electrode connected to the second sensing output terminal.

Yet another embodiment of the present disclosure provides a method for driving a display device including a gate driver for applying a scan signal to a plurality of scan lines connected to a plurality of pixels, the gate driver including a plurality of gate driving circuit blocks, the method including applying a first carry signal output by a previous gate driving circuit block at a previous stage to a first control node through a first input terminal to precharge the first control node, outputting a second carry signal to be transmitted to a first input terminal of a subsequent gate driving circuit block at a next stage based on a carry clock signal input to a carry clock input terminal by a voltage at the first control node, outputting a first scan signal to a first scan line based on a first scan clock signal input to a first scan clock input terminal by a voltage at the first control node, and outputting a second scan signal to a second scan line based on a second scan clock signal input to a second scan clock input terminal by a voltage at the first control node.

The method may further include bootstrapping a voltage at the first control node by a first scan clock signal input to the first scan clock input terminal, and bootstrapping a voltage at the first control node by a second scan clock signal input to the second scan clock input terminal.

A first period for outputting a first scan signal to the first scan line may partly overlap a second period for outputting a second scan signal to the second scan line.

The method may further include outputting a first sensing signal to a first sensing line based on a first sensing clock signal input to a first sensing clock input terminal by a voltage at the first control node, and outputting a second sensing signal to a second sensing line based on a second sensing clock signal input to a second sensing clock input terminal by a voltage at the first control node.

A plurality of gate driving circuits according to disclosed embodiments may respectively output a scan signal to a plurality of scan lines. Accordingly, the number of gate driving circuits included in the display device may be reduced. As the number of gate driving circuits is reduced, the region occupied by the gate driving circuit may also be reduced along with a corresponding dead space of the display device.

Further, a gate driving circuit that is strong against noise may be provided by reinforcing the bootstrap of the gate driving circuit.

DETAILED DESCRIPTION

Figure 1:
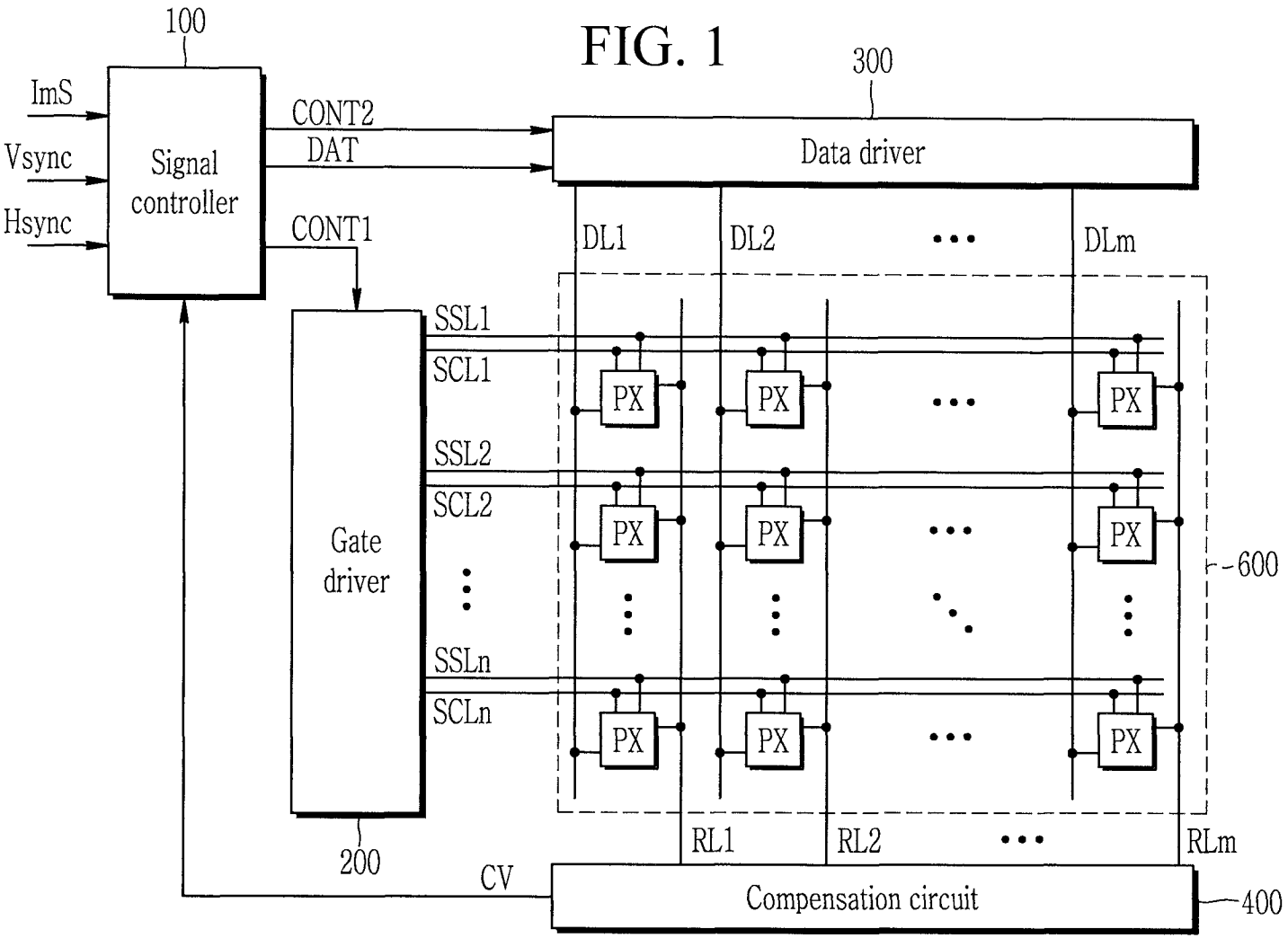
FIG. 1 shows a block diagram of a display device according to an embodiment of the present disclosure.

Features of the inventive concept and methods of accomplishing the same may be understood more readily by reference to the detailed description of embodiments and the accompanying drawings. Hereinafter, embodiments will be described in more detail with reference to the accompanying drawings. The described embodiments, however, may be embodied in various different forms, and should not be construed as being limited to only the illustrated embodiments herein. Rather, these embodiments are provided as examples so that this disclosure will be thorough and complete, and will fully convey the aspects and features of the present inventive concept to those skilled in the art. Accordingly, processes, elements, and techniques that are not necessary to those having ordinary skill in the art for a complete understanding of the aspects and features of the present inventive concept may not be described. Unless otherwise noted, like reference numerals denote like elements throughout the attached drawings and the written description, and thus, descriptions thereof will not be repeated. Further, parts not related to the description of the embodiments might not be shown to make the description clear. In the drawings, the relative sizes of elements, layers, and regions may be exaggerated for clarity.

Various embodiments are described herein with reference to sectional illustrations that are schematic illustrations of embodiments and/or intermediate structures. As such, variations from the shapes of the illustrations as a result, for example, of manufacturing techniques and/or tolerances, are to be expected. Further, specific structural or functional descriptions disclosed herein are merely illustrative for the purpose of describing embodiments according to the concept of the present disclosure. Thus, embodiments disclosed herein should not be construed as limited to the particular illustrated shapes of regions, but are to include deviations in shapes that result from, for instance, manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the drawings are schematic in nature and their shapes are not intended to illustrate the actual shape of a region of a device and are not intended to be limiting. Additionally, as those skilled in the art would realize, the described embodiments may be modified in various different ways, all without departing from the spirit or scope of the present disclosure.

In the detailed description, for the purposes of explanation, numerous specific details are set forth to provide a thorough understanding of various embodiments. It is apparent, however, that various embodiments may be practiced without these specific details or with one or more equivalent arrangements. In other instances, well-known structures and devices are shown in block diagram form in order to avoid unnecessarily obscuring various embodiments.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. Similarly, when a first part is described as being arranged "on" a second part, this indicates that the first part is arranged at an upper side or a lower side of the second part without the limitation to the upper side thereof on the basis of the gravity direction.

It will be understood that when an element, layer, region, or component is referred to as being "on," "connected to," or "coupled to" another element, layer, region, or component, it can be directly on, connected to, or coupled to the other element, layer, region, or component, or one or more intervening elements, layers, regions, or components may be present. However, "directly connected/directly coupled" refers to one component directly connecting or coupling another component without an intermediate component. Meanwhile, other expressions describing relationships between components such as "between," "immediately between" or "adjacent to" and "directly adjacent to" may be construed similarly. In addition, it will also be understood that when an element or layer is referred to as being "between" two elements or layers, it can be the only element or layer between the two elements or layers, or one or more intervening elements or layers may also be present.

For the purposes of this disclosure, expressions such as "at least one of," when preceding a list of elements, modify the entire list of elements and do not modify the individual elements of the list. For example, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises," "comprising," "have," "having," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

As used herein, the term "substantially," "about," "approximately," and similar terms are used as terms of approximation and not as terms of degree, and are intended to account for the inherent deviations in measured or calculated values that would be recognized by those of ordinary skill in the art. "About" or "approximately," as used herein, is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value. Further, the use of "may" when describing embodiments of the present disclosure refers to "one or more embodiments of the present disclosure." As used herein, the terms "use," "using," and "used" may be considered synonymous with the terms "utilize," "utilizing," and "utilized," respectively. Also, the term "exemplary" is intended to refer to an example or illustration.

When a certain embodiment may be implemented differently, a specific process order may be performed differently from the described order. For example, two consecutively described processes may be performed substantially at the same time or performed in an order opposite to the described order.

The electronic or electric devices and/or any other relevant devices or components according to embodiments of the present disclosure described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the embodiments of the present disclosure.

Unless otherwise defined, all terms (including technical and scientific terms) used herein have the same meaning as commonly understood by one of ordinary skill in the art to which the present inventive concept belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 shows a block diagram of a display device according to an embodiment of the present disclosure.

Referring to FIG. 1, the display device includes a signal controller 100, a gate driver 200, a data driver 300, a compensation circuit 400, and a display unit 600.

The signal controller 100 receives an image signal ImS and a synchronization signal from an external device. The image signal ImS includes luminance information of a plurality of pixels PX. The luminance information includes a predetermined number (e.g., 1024 (i.e., $2^{10}$), 256 (i.e., $2^8$), or 64 (i.e., $2^6$) gray levels. The synchronization signal may include a horizontal synchronizing signal Hsync and a vertical synchronization signal Vsync.

The signal controller 100 may distinguish the image signal ImS per frame according to the vertical synchronization signal Vsync, and may distinguish the image signal ImS per each of scan lines SCL1-SCLn according to the horizontal synchronizing signal Hsync. The signal controller 100 may appropriately process the image signal ImS according to operating conditions of the display unit 600 and the data driver 300 based on the image signal ImS and the synchronization signal, and may generate an image data signal DAT, a first control signal CONT1, and a second control signal CONT2. The signal controller 100 transmits the first control signal CONT1 to the gate driver 200. The signal controller 100 transmits the second control signal CONT2 and the image data signal DAT to the data driver 300.

The display unit 600 includes a plurality of scan lines SCL1-SCLn, a plurality of sensing lines SSL1-SSLn, a plurality of data lines DL1-DLm, a plurality of receiving lines RL1-RLm, and a plurality of pixels PX. The pixels PX may be respectively connected to a plurality of scan lines SL1-SLn, a plurality of sensing lines SSL1-SSLn, a plurality of data lines DL1-DLm, and a plurality of receiving lines RL1-RLm. The scan lines SCL1-SCLn may substantially extend in a row direction and may be substantially parallel to each other. The sensing lines SSL1-SSLn may substantially extend in the row direction and may be substantially parallel to each other. The data lines DL1-DLm may substantially extend in a column direction and may be substantially parallel to each other. The receiving lines RL1-RLm may substantially extend in the column direction and may be substantially parallel to each other. The display unit 600 may correspond to a display area in which the image is displayed.

In some embodiments, a first power voltage (refer to ELVDD of FIG. 2) and a second power voltage (refer to ELVSS of FIG. 2) may be supplied to the display unit 600. The first power voltage ELVDD may be a high level voltage supplied to an anode of a light emitting diode (refer to LED of FIG. 2) included in the respective pixels PX. The second power voltage ELVSS may be a low level voltage supplied to a cathode of the light emitting diode LED included in the respective pixels PX. The first power voltage ELVDD and the second power voltage ELVSS are driving voltages for emitting light from a plurality of pixels PX.

The gate driver 200 is connected to a plurality of scan lines SCL1-SCLn and a plurality of sensing lines SSL1-SSLn. The gate driver 200 applies a scan signal that is a combination of a gate-on voltage and a gate-off voltage to a plurality of scan lines SCL1-SCLn according to the first control signal CONT1, and applies a sensing signal that is a combination of a gate-on voltage and a gate-off voltage to a plurality of sensing lines SSL1-SSLn. The gate driver 200 may sequentially apply a scan signal with a gate-on voltage to a plurality of scan lines SCL1-SCLn (e.g., to the scan lines SCL1-SCLn in a sequential manner). The gate driver 200 may sequentially apply a sensing signal with a gate-on voltage to a plurality of sensing lines SSL1-SSLn (e.g., to the sensing lines SSL1-SSLn in a sequential manner).

Figure 3:
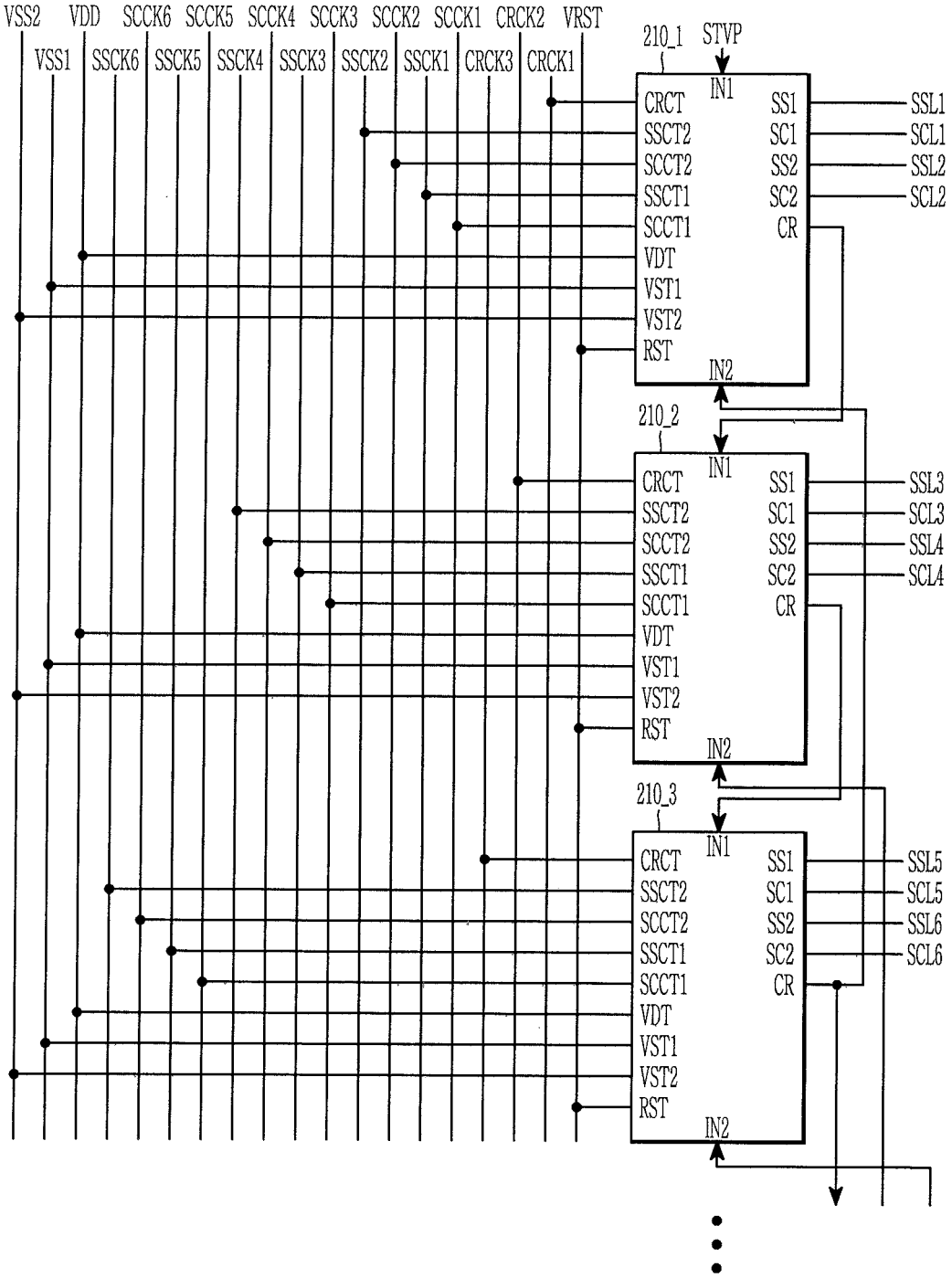
FIG. 3 and FIG. 4 show block diagrams of a plurality of gate driving circuit blocks included in a gate driver according to an embodiment of the present disclosure.
Figure 4:
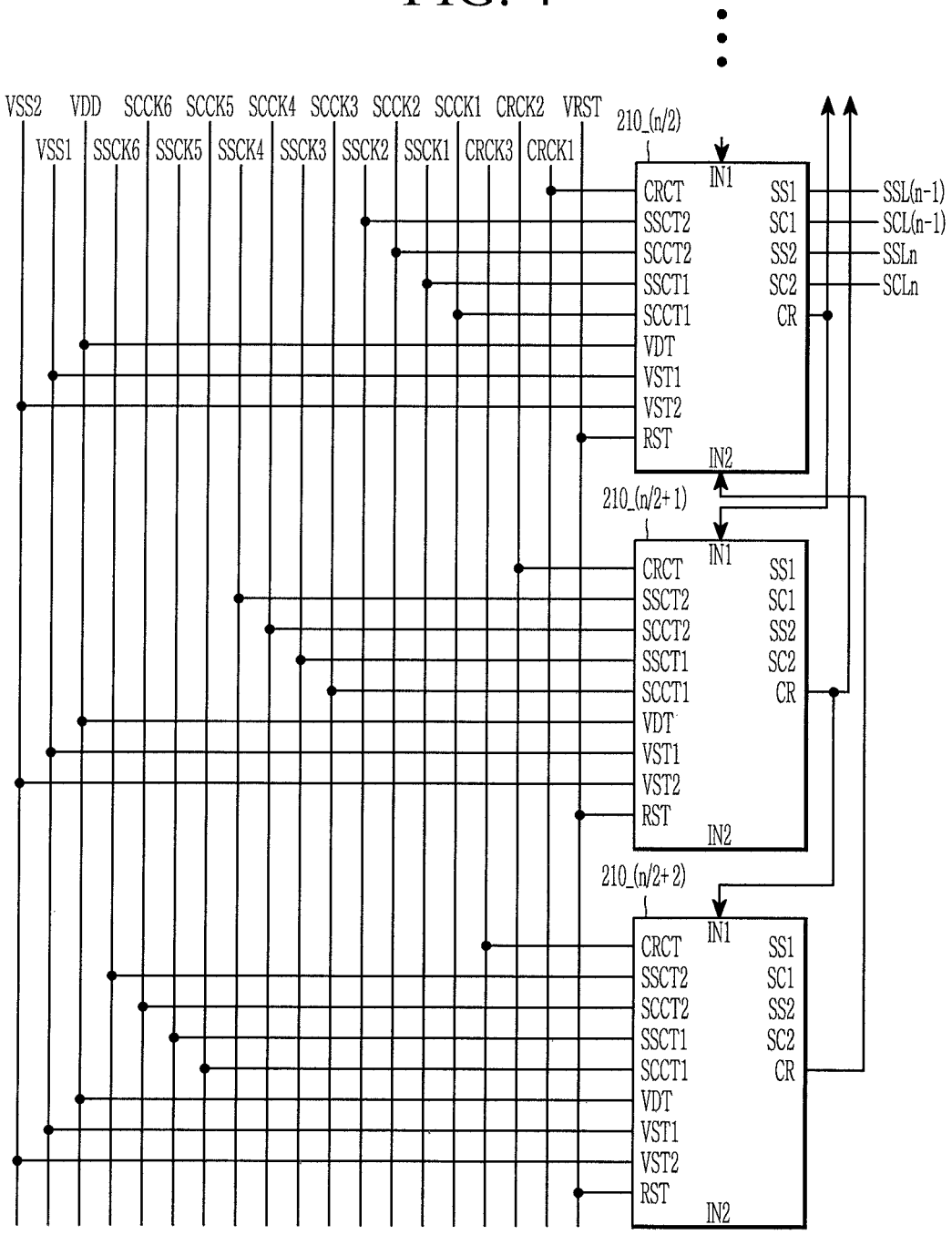

The gate driver 200 may include a plurality of gate driving circuit blocks (refer to 210_1, 210_2, 210_3, . . . , 210_*n*/2 of FIG. 3 and FIG. 4) and dummy circuit blocks (refer to 210_(*n*/2+1) and 210_(*n*/2+2) of FIG. 4). The respective gate driving circuit blocks may each apply a scan signal and a sensing signal to at least two scan lines and at least two sensing lines. The number of the gate driving circuit blocks may be less than the number of scan lines SCL1-SCLn, the number of sensing lines SSL1-SSLn, or the number of pixel rows. For example, when the number of at least one of the scan lines SCL1-SCLn, the sensing lines SSL1-SSLn, and the pixel rows is n, the number of the gate driving circuit blocks may be n/2, not including the dummy circuit block. Here, n is an integer that is equal to or greater than 2. A detailed description thereof will be given in later with reference to FIG. 3 and FIG. 4.

The data driver 300 is connected to a plurality of data lines DL1-DLm, and samples and holds an image data signal DAT according to a second control signal CONT2, and also applies a respective data voltage (refer to Vdat of FIG. 2) to a plurality of data lines DL1-DLm. The data driver 300 may apply a data voltage Vdat (e.g., a data voltage Vdat within a predetermined voltage range) to a plurality of data lines DL1-DLm corresponding to a timing of a respective gate signal of a gate-on voltage.

The compensation circuit 400 is connected to a plurality of receiving lines RL1-RLm, and receives a current flowing to a plurality of pixels PX through a plurality of receiving lines RL1-RLm. The compensation circuit 400 may measure a threshold voltage of a driving transistor (refer to TR1 FIG. 2) included in a respective one of each of the pixels PX based on the received current, and may calculate an amount of variation of the threshold voltage. The compensation circuit 400 may calculate respective degradations of a plurality of driving transistors TR1 included in a plurality of pixels PX and respective deviations of a plurality of driving transistors TR1 based on the amount of variation of the threshold voltage of the driving transistor TR1. The compensation circuit 400 may generate a compensation value CV based on the degradations and deviations of a plurality of driving transistors TR1, and may provide the same to the signal controller 100.

The signal controller 100 may apply the compensation value CV to an image signal ImS to generate an image data signal DAT. The signal controller 100 may improve the deterioration of image quality caused by degradation of the driving transistor TR1 by applying the compensation value CV to the image signal ImS.

FIG. 1 shows that the compensation circuit 400 is provided separately from the signal controller 100, although in other embodiments the compensation circuit 400 may be included in the signal controller 100.

Figure 2:
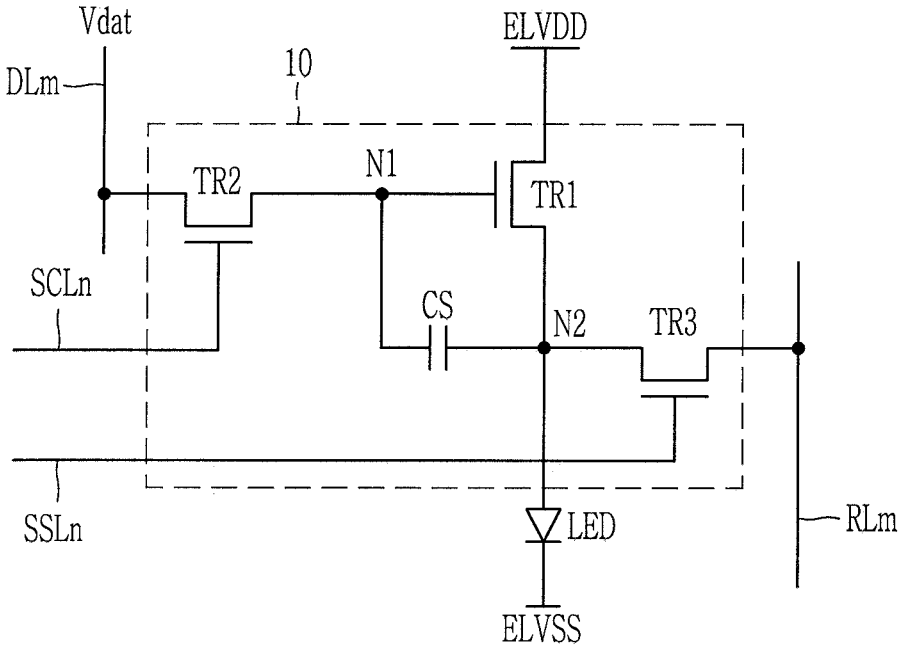
FIG. 2 shows a circuit diagram of a pixel according to an embodiment included in a display device of FIG. 1.

FIG. 2 shows a circuit diagram of a pixel according to an embodiment included in a display device of FIG. 1. The pixel PX provided in an n-th pixel row and an m-th pixel column from among a plurality of pixels PX included in the display device of FIG. 1 will now be exemplified.

Referring to FIG. 2, the pixel PX includes a light emitting diode LED and a pixel circuit 10.

The pixel circuit 10 is configured to control the current flowing to the light emitting diode LED from the first power voltage ELVDD. The pixel circuit 10 may include a driving transistor TR1, a switching transistor TR2, a sensing transistor TR3, and a storage capacitor CS.

The driving transistor TR1 includes a gate electrode connected to a first node N1, a first electrode connected to a first power voltage ELVDD, and a second electrode connected to a second node N2. The driving transistor TR1 is connected between the first power voltage ELVDD and the light emitting diode LED, and controls an amount of current flowing to the light emitting diode LED from the first power voltage ELVDD corresponding to a voltage at the first node N1.

The switching transistor TR2 includes a gate electrode connected to a scan line SCLn, a first electrode connected to a data line DLm, and a second electrode connected to the first node N1. The switching transistor TR2 is connected between the data line DLm and the driving transistor TR1, and is turned on according to a scan signal of a gate-on voltage applied to the scan line SCLn to transmit a data voltage Vdat applied to the data line DLm to the first node N1.

The sensing transistor TR3 includes a gate electrode connected to a sensing line SSLn, a first electrode connected to a second node N2, and a second electrode connected to a receiving line RLm. The sensing transistor TR3 is connected between a second electrode of the driving transistor TR1 and the receiving line RLm, and is turned on according to a sensing signal of a gate-on voltage applied to the sensing line SSLn to transmit the current flowing through the driving transistor TR1 to the receiving line RLm.

The driving transistor TR1, the switching transistor TR2, and the sensing transistor TR3 may be n-channel electric field effect transistors. The gate-on voltage for turning on the n-channel electric field effect transistor is a high level voltage, and the gate-off voltage for turning it off is a low level voltage. According to other embodiments, at least one of the driving transistor TR1, the switching transistor TR2, and the sensing transistor TR3 may be a p-channel electric field effect transistor. The gate-on voltage for turning on the p-channel electric field effect transistor is a low level voltage, and the gate-off voltage for turning it off is a high level voltage.

The storage capacitor CS includes a first electrode connected to the first node N1 and a second electrode connected to the second node N2. A data voltage Vdat is transmitted to the first node N1, and the storage capacitor CS maintains the voltage at the first node N1.

The light emitting diode LED includes an anode connected to the second node N2 and a cathode connected to the second power voltage ELVSS. The light emitting diode LED may be connected between the pixel circuit 10 and the second power voltage ELVSS to emit light with luminance corresponding to a current supplied by the pixel circuit 10. The light emitting diode LED may include an emission layer including at least one of an organic light-emitting material and an inorganic light-emitting material. Holes and electrons may be injected into the emission layer from the anode and the cathode, respectively, and light is emitted when excitons, which are a combination of the injected holes and electrons, transition to a ground state from an excited state. The light emitting diode LED may emit, for example, light of a primary color or white light. An example of the primary colors may be red, green, and blue. Another example of the primary colors may be yellow, cyan, and magenta.

FIG. 3 and FIG. 4 show block diagrams of a plurality of gate driving circuit blocks included in a gate driver according to an embodiment of the present disclosure.

Referring to FIG. 3 and FIG. 4, the gate driver 200 includes a plurality of gate driving circuit blocks 210_1, 210_2, 210_3, . . . , 210_($n$/2) sequentially arranged and dependently connected, and also includes dummy circuit blocks 210_($n$/2+1) and 210_($n$/2+2). From among a plurality of gate driving circuit blocks included in the gate driver 200, FIG. 3 shows first to third gate driving circuit blocks 210_1, 210_2, and 210_3 sequentially arranged, and FIG. 4 shows an n/2-th gate driving circuit block 210_($n$/2) and two dummy circuit blocks 210_($n$/2+1) and 210_($n$/2+2) sequentially arranged.

Each of the gate driving circuit blocks 210_1, 210_2, 210_3, . . . , 210_($n$/2) respectively include a first input terminal IN1, a second input terminal IN2, a carry clock input terminal CRCT, a first scan clock input terminal SCCT1, a first sensing clock input terminal SSCT1, a second scan clock input terminal SCCT2, a second sensing clock input terminal SSCT2, an on-voltage terminal VDT, a first off-voltage terminal VST1, a second off-voltage terminal VST2, a reset terminal RST, a first scan output terminal SC1, a first sensing output terminal SS1, a second scan output terminal SC2, a second sensing output terminal SS2, and a carry output terminal CR. The dummy circuit blocks 210_($n$/2+1) and 210_($n$/2+2) are configured to be the same as the gate driving circuit blocks 210_1, 210_2, 210_3, . . . , 210_($n$/2).

The first input terminal IN1 is connected to a carry output terminal CR of the gate driving circuit block at a previous stage (e.g., a previous gate driving circuit block) to receive a carry signal. However, a first input terminal IN1 of the first gate driving circuit block 210_1 receives a scan start signal STVP.

The second input terminal IN2 may be connected to a carry output terminal CR of a gate driving circuit block at the stage after next (e.g., a stage subsequent to an immediately subsequent stage), and may receive a carry signal from the stage after next.

A first dummy circuit block 210_($n$/2+1) and a second dummy circuit block 210_($n$/2+2) may be formed so that an (n/2−1)-th gate driving circuit block (not shown) and an (n/2)-th gate driving circuit block 210_($n$/2) may receive a carry signal from the stage after next. A carry output terminal CR of the first dummy circuit block 210_($n$/2+1) is connected to the second input terminal IN2 of an (n/2−1)-th gate driving circuit block, and a carry output terminal CR of the second dummy circuit block 210_($n$/2+2) may be connected to the second input terminal IN2 of the (n/2)-th gate driving circuit block 210_($n$/2).

The first dummy circuit block 210_($n$/2+1) and the second dummy circuit block 210_($n$/2+2) need not be connected to a scan line or a sensing line. According to an embodiment, the first dummy circuit block 210_($n$/2+1) and the second dummy circuit block 210_($n$/2+2) may be connected to a dummy scan line and a dummy sensing line, the dummy scan line and the dummy sensing line being connected to a dummy pixel that does not display an image, such that the first dummy circuit block 210_($n$/2+1) and the second dummy circuit block 210_($n$/2+2) are not used to display an image.

One of three carry clock signals CRCK1, CRCK2, and CRCK3 is input to a carry clock input terminal CRCT. Phases of the three carry clock signals CRCK1, CRCK2, and CRCK3 may be different from each other. The first carry clock signal CRCK1 may be input to a carry clock input terminal CRCT of the first gate driving circuit block 210_1, the second carry clock signal CRCK2 may be input to a carry clock input terminal CRCT of the second gate driving circuit block 210_2, and the third carry clock signal CRCK3 may be input to a carry clock input terminal CRCT of the third gate driving circuit block 210_3. That is, the three carry clock signals CRCK1, CRCK2, and CRCK3 may be sequentially and alternately input to a plurality of gate driving circuit blocks 210_1, 210_2, 210_3, . . . , 210_($n$/2) and dummy circuit blocks 210_($n$/2+1) and 210_($n$/2+2). For example, the third carry clock signal CRCK3 is input to the gate driving circuit block and the dummy circuit block in an order corresponding to a multiple of 3, the first carry clock signal CRCK1 is input to the gate driving circuit block and the dummy circuit block in an order corresponding to a multiple of 3, plus 1, and the second carry clock signal CRCK2 is input to the gate driving circuit block and the dummy circuit block in an order corresponding to a multiple of 3, plus 2.

A respective pair of the six scan clock signals SCCK1, SCCK2, SCCK3, SCCK4, SCCK5, and SCCK6 may be input to each of the gate driving circuit blocks. For example, respective ones of the six scan clock signals SCCK1, SCCK2, SCCK3, SCCK4, SCCK5, and SCCK6 may be input, one by one, to respective ones of the first scan clock input terminal SCCT1 and the second scan clock input terminal SCCT2 of the gate driving circuit blocks. The phases of the six scan clock signals SCCK1, SCCK2, SCCK3, SCCK4, SCCK5, and SCCK6 may be different from each other.

For example, the first scan clock signal SCCK1 and the second scan clock signal SCCK2 may be input to the first scan clock input terminal SCCT1 and the second scan clock input terminal SCCT2 of the first gate driving circuit block 210_1, respectively. The third scan clock signal SCCK3 and the fourth scan clock signal SCCK4 may be input to the first scan clock input terminal SCCT1 and the second scan clock input terminal SCCT2 of the second gate driving circuit block 210_2, respectively. The fifth scan clock signal SCCK5 and the sixth scan clock signal SCCK6 may be input to the first scan clock input terminal SCCT1 and the second scan clock input terminal SCCT2 of the third gate driving circuit block 210_3, respectively.

That is, two of the six scan clock signals SCCK1, SCCK2, SCCK3, SCCK4, SCCK5, and SCCK6 may be sequentially and alternately input to a plurality of gate driving circuit blocks 210_1, 210_2, 210_3, . . . , 210_$n$/2 and dummy circuit blocks 210_($n$/2+1) and 210_($n$/2+2). For example, the fifth scan clock signal SCCK5 and the sixth scan clock signal SCCK6 are input to the gate driving circuit block and the dummy circuit block in order corresponding to the multiple of 3, the first scan clock signal SCCK1 and the second scan clock signal SCCK2 are input to the gate driving circuit block and the dummy circuit block in order corresponding to the multiple of 3, plus 1, and the third scan clock signal SCCK3 and the fourth scan clock signal SCCK4 are input to the gate driving circuit block and the dummy circuit block in order corresponding to the multiple of 3, plus 2.

Similarly, two of the six sensing clock signals SSCK1, SSCK2, SSCK3, SSCK4, SSCK5, and SSCK6 may be input, one by one, to the first sensing clock input terminal SSCT1 and the second sensing clock input terminal SSCT2. The phases of the six sensing clock signals SSCK1, SSCK2, SSCK3, SSCK4, SSCK5, and SSCK6 may be different from each other.

The first sensing clock signal SSCK1 and the second sensing clock signal SSCK2 may be input to the first sensing clock input terminal SSCT1 and the second sensing clock input terminal SSCT2 of the first gate driving circuit block 210_1, respectively. The third sensing clock signal SSCK3 and the fourth sensing clock signal SSCK4 may be input to the first sensing clock input terminal SSCT1 and the second sensing clock input terminal SSCT2 of the second gate driving circuit block 210_2, respectively. The fifth sensing clock signal SSCK5 and the sixth sensing clock signal SSCK6 may be respectively input to the first sensing clock input terminal SSCT1 and the second sensing clock input terminal SSCT2 of the third gate driving circuit block 210_3.

That is, the six sensing clock signals SSCK1, SSCK2, SSCK3, SSCK4, SSCK5, and SSCK6 may be sequentially alternately input, two by two, to a plurality of gate driving circuit blocks 210_1, 210_2, 210_3, . . . , 210_($n$/2) and dummy circuit blocks 210_($n$/2+1) and 210_($n$/2+2). For example, the fifth sensing clock signal SSCK5 and the sixth sensing clock signal SSCK6 may be input to the gate driving circuit block and the dummy circuit block in order of the multiple of 3 (e.g., third, sixth, ninth, twelfth, etc.), the first sensing clock signal SSCK1 and the second sensing clock signal SSCK2 may be input to the gate driving circuit block and the dummy circuit block in order of the multiple of 3, plus 1 (e.g., first, fourth, seventh, tenth, etc.), and the third sensing clock signal SSCK3 and the fourth sensing clock signal SSCK4 may be input to the gate driving circuit block and the dummy circuit block in order of the multiple of 3, plus 2 (e.g., second, fifth, eighth, eleventh, etc.).

A high-level on voltage VDD is input to an on-voltage terminal VDT. The on voltage VDD may be input in common to a plurality of gate driving circuit blocks 210_1, 210_2, 210_3, . . . , 210_(*n*/2) and dummy circuit blocks 210_(*n*/2+1) and 210_(*n*/2+2).

A low-level first off voltage VSS1 is input to the first off-voltage terminal VST1, and a low-level second off voltage VSS2 is input to the second off-voltage terminal VST2. The second off voltage VSS2 may be lower than the first off voltage VSS1. The first off voltage VSS1 and the second off voltage VSS2 may be input in common to a plurality of gate driving circuit blocks 210_1, 210_2, 210_3, . . . , 210_(*n*/2) and dummy circuit blocks 210_(*n*/2+1) and 210_(*n*/2+2).

One case in which the on-voltage VDD is a high-level voltage and the first off voltage VSS1 and the second off voltage VSS2 are low-level voltages has been exemplified. In other embodiments, the on voltage VDD may be a low level voltage and the first off voltage VSS1 and the second off voltage VSS2 may be high-level voltages according to types of transistors included in a plurality of gate driving circuit blocks 210_1, 210_2, 210_3, . . . , 210_(*n*/2) and dummy circuit blocks 210_(*n*/2+1) and 210_(*n*/2+2).

A reset signal VRST is input to the reset terminal RST. The reset signal VRST is a signal for resetting a voltage at the first control node (refer to Q of FIG. 5) respectively included in a plurality of gate driving circuit blocks 210_1, 210_2, 210_3, . . . , 210_(*n*/2) and dummy circuits block 210_(*n*/2+1) and 210_(*n*/2+2) to be an off voltage. The reset signal VRST may be concurrently or simultaneously input to a plurality of gate driving circuit blocks 210_1, 210_2, 210_3, . . . , 210_(*n*/2) and dummy circuit blocks 210_(*n*/2+1) and 210_(*n*/2+2).

The first scan output terminal SC1 is connected to a scan line corresponding to one pixel row, and the second scan output terminal SC2 is connected to a scan line corresponding to a next pixel row. For example, the first scan output terminal SC1 may be connected to an odd-numbered scan line, and the second scan output terminal SC2 may be connected to an even-numbered adjacent scan line. A scan signal corresponding to an odd-numbered scan line is output through the first scan output terminal SC1, and a scan signal corresponding to an even-numbered scan line may be output through the second scan output terminal SC2.

The first sensing output terminal SS1 is connected to a sensing line corresponding to one pixel row, and the second sensing output terminal SS2 is connected to a sensing line corresponding a next adjacent pixel row. For example, the first sensing output terminal SS1 may be connected to an odd-numbered sensing line, and the second sensing output terminal SS2 may be connected to an even-numbered sensing line. A sensing signal corresponding to an odd-numbered sensing line may be output through the first sensing output terminal SS1, and a sensing signal corresponding to an even-numbered sensing line may be output through the second sensing output terminal SS2.

That is, a plurality of gate driving circuit blocks 210_1, 210_2, 210_3, . . . , 210_(*n*/2) may be respectively connected to the scan line and the sensing line corresponding to each of two pixel rows. The number of a plurality of gate driving circuit blocks 210_1, 210_2, 210_3, . . . , 210_(*n*/2) may be half the number n of a plurality of scan lines or a plurality of sensing lines.

The carry output terminal CR is connected to a first input terminal IN1 of a gate driving circuit block at the next stage (e.g., a subsequent gate driving circuit block), and also to a second input terminal IN2 at the stage preceding the immediately previous stage (e.g., a stage before last). A carry signal output through a carry output terminal CR is input to a first input terminal IN1 of the gate driving circuit block at the next stage, and to a second input terminal IN2 of the gate driving circuit block at the stage before the previous stage. However, there is no "stage before the previous stage" for either the first gate driving circuit block 210_1 or the second gate driving circuit block 210_2, so the carry output terminal CR of the first gate driving circuit block 210_1 is connected to the second gate driving circuit block 210_2 as the next stage, and the carry output terminal CR of the second gate driving circuit block 210_2 is connected to the third gate driving circuit block 210_3 as the next stage.

A plurality of gate driving circuit blocks 210_1, 210_2, 210_3, . . . , 210_(*n*/2) may be configured to output a scan signal to an odd-numbered scan line through the first scan output terminal SC1 in synchronization with, or based on, a signal input to the first input terminal IN1 and a scan clock signal input to the first scan clock input terminal SCCT1. The scan clock signal input to the first scan clock input terminal SCCT1 may bootstrap the voltage of the signal input to the first input terminal IN1.

A plurality of gate driving circuit blocks 210_1, 210_2, 210_3, . . . , 210_(*n*/2) may be configured to output a sensing signal to an odd-numbered sensing line through the first sensing output terminal SS1 in synchronization with, or based on, a signal input to the first input terminal IN1 and a sensing clock signal input to the first sensing clock input terminal SSCT1. The sensing clock signal input to the first sensing clock input terminal SSCT1 may bootstrap the voltage of the signal input to the first input terminal IN1.

A plurality of gate driving circuit blocks 210_1, 210_2, 210_3, . . . , 210_(*n*/2) may be configured to output a scan signal to an even-numbered scan line through the second scan output terminal SC2 in synchronization with, or based on, a signal input to the first input terminal IN1 and a scan clock signal input to the second scan clock input terminal SCCT2. The scan clock signal input to the second scan clock input terminal SCCT2 may bootstrap the voltage of the signal input to the first input terminal IN1.

A plurality of gate driving circuit blocks 210_1, 210_2, 210_3, . . . , 210_(*n*/2) may be configured to output a sensing signal to an even-numbered sensing line through the second sensing output terminal SS2 in synchronization with, or based on, a signal input to the first input terminal IN1 and a sensing clock signal input to the second sensing clock input terminal SSCT2. The sensing clock signal input to the second sensing clock input terminal SSCT2 may bootstrap the voltage of the signal input to the first input terminal IN1.

A plurality of gate driving circuit blocks 210_1, 210_2, 210_3, . . . , 210_*n*/2 may be configured to output a carry signal through the carry output terminal CR in synchronization with, or based on, a signal input to the first input terminal IN1 and a carry clock signal input to the carry clock input terminal CRCT. The carry clock signal input to the carry clock input terminal CRCT might not be involved in the bootstrapping of the voltage of the signal input to the first input terminal IN1. Accordingly, the signal having a voltage range that is lower than the scan clock signal or the sensing clock signal may be used as a carry clock signal. That is, a voltage level of a gate-on voltage of the carry clock signal may be less than a voltage level of a gate-on voltage of the scan clock signal or the sensing clock signal.

In addition, the first dummy circuit block 210_($n$/2+1) and the second dummy circuit block 210_($n$/2+2) may be configured to be the same as the gate driving circuit block, and may be operated in a similar manner except that they are not connected to the scan line and the sensing line.

As described, a plurality of gate driving circuit blocks 210_1, 210_2, 210_3, . . . , 210_($n$/2) are configured to allow a scan signal output through the first scan output terminal SC1, a scan signal output through the second scan output terminal SC2, a sensing signal output through the first sensing output terminal SS1, and a sensing signal output through the second sensing output terminal SS2 to be output in synchronization with, or based on, different clock signals. Further, a voltage of a signal input to the first input terminal IN1 may essentially be bootstrapped twice by the scan clock signal and the sensing clock signal. Accordingly, the scan signal and the sensing signal may be stably output, and a leakage current or noise in the gate driving circuit block may be reduced.

Further, carry signals output through respective carry output terminals CR of a plurality of gate driving circuit blocks 210_1, 210_2, 210_3, . . . , 210_($n$/2) are output in synchronization with, or based on, the scan clock signal, the sensing clock signal, and an additional carry clock signal, and the carry clock signal input to the carry clock input terminal CRCT is configured to not relate to the bootstrapping of the voltage of the signal input to the first input terminal IN1, so the carry signal may be stably output, and so a plurality of dependently connected gate driving circuit blocks 210_1, 210_2, 210_3, . . . , 210_($n$/2) may be stably operated by the carry signal.

In another way, when the scan clock signal and the sensing clock signal relating to the outputting of the scan signal and the sensing signal of a plurality of gate driving circuit blocks 210_1, 210_2, 210_3, . . . , 210_($n$/2) are referred to as output clock signals, the number NO of the outputs of the scan signal and the sensing signal of a plurality of gate driving circuit blocks 210_1, 210_2, 210_3, . . . , 210_($n$/2) may link to the entire number NG of the output clock signals and the entire number NC of the carry clock signals used in the operation of the gate driver 200 as expressed in Equation 1, which is expressed in two different ways below.

$$NO=NG/NC$$

$$NG=NC\times NO \qquad \text{Equation 1}$$

As exemplified with reference to FIG. 3 and FIG. 4, the number NO of the outputs of the scan signal and the sensing signal of a plurality of respective gate driving circuit blocks 210_1, 210_2, 210_3, . . . , 210_($n$/2) is 4, the entire number NG of the output clock signals is 12, and the entire number NC of the carry clock signals is 3. As described, the entire number NG (e.g., 12) of the output clock signals may correspond to a value of the product of the number NO (e.g., 4) of the outputs of the scan signal and the sensing signal of a plurality of respective gate driving circuit blocks 210_1, 210_2, 210_3, . . . , 210_($n$/2) and the entire number NC (e.g., 3) of the carry clock signals.

Conventionally, one gate driving circuit is needed for one scan line. However, as described above, the respective gate driving circuit blocks 210_1, 210_2, 210_3, . . . , 210_($n$/2) according to an embodiment of the present disclosure may each output the scan signal and the sensing signal for two respective scan lines and two respective sensing lines. Accordingly, the number of the gate driving circuit blocks 210_1, 210_2, 210_3, . . . , 210_($n$/2) may be half that of the prior art. Accordingly, the region occupied by a plurality of gate driving circuit blocks 210_1, 210_2, 210_3, . . . , 210_($n$/2) may be reduced in the peripheral area, and the dead space of the display device may be reduced.

A gate driving circuit according to an embodiment of the present disclosure will now be described with reference to FIG. 5, and a method for driving a display device including a gate driving circuit will now be described with reference to FIG. 6.

Figure 5:
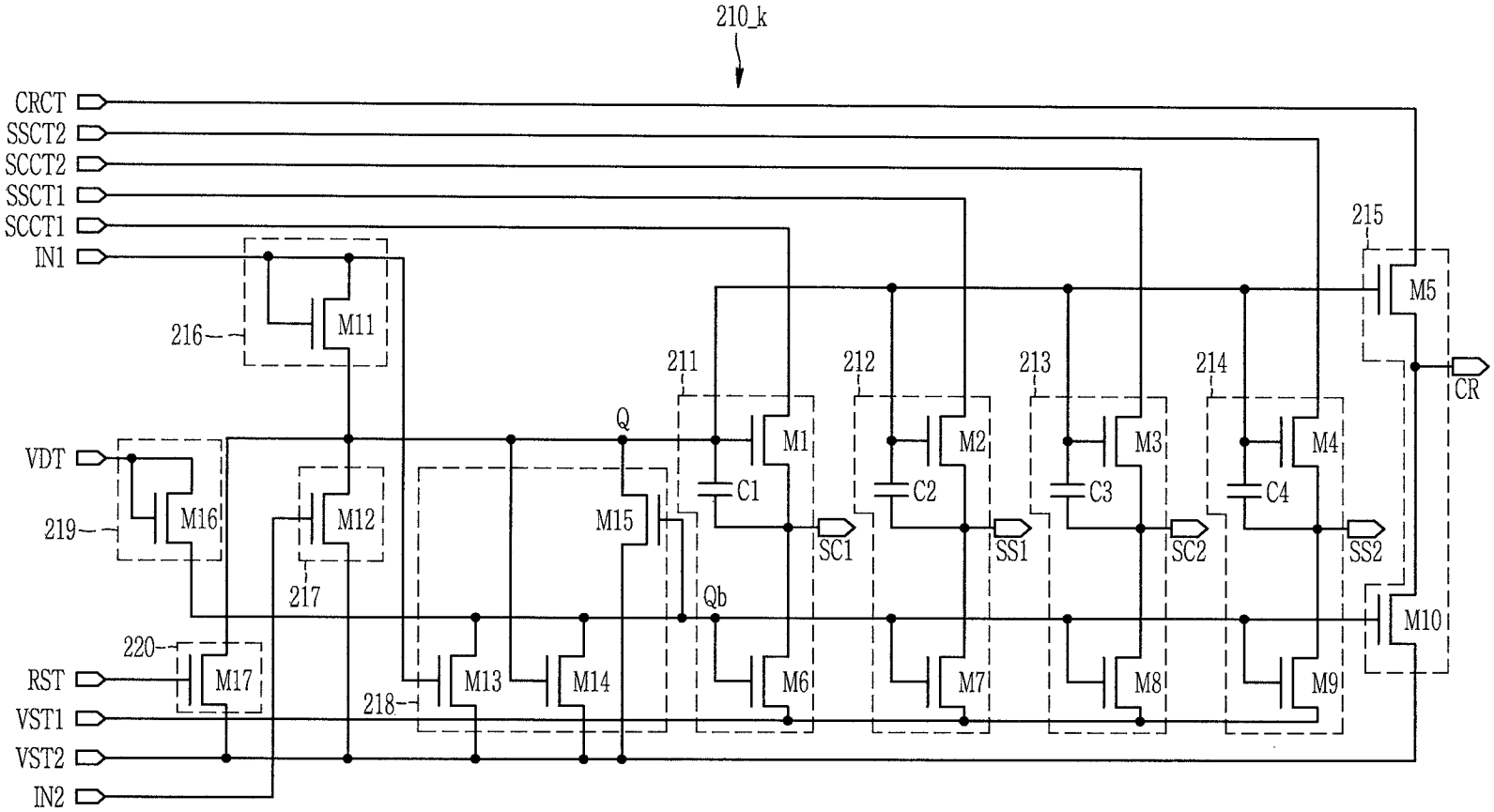
FIG. 5 shows a circuit diagram of a gate driving circuit block according to an embodiment of the present disclosure.

FIG. 5 shows a circuit diagram of a gate driving circuit block according to an embodiment of the present disclosure.

Referring to FIG. 5, a k-th gate driving circuit block 210_$k$ from among a plurality of gate driving circuit blocks included in a gate driver 200 is shown. Here, it is given that $1<k\leq n/2$.

The gate driving circuit block 210_$k$ includes a first scan signal output unit 211, a first sensing signal output unit 212, a second scan signal output unit 213, a second sensing signal output unit 214, a carry signal output unit 215, a pull-up controller 216, a pull-down controller 217, a control node stabilizer 218, an on voltage provider 219, and a reset unit 220.

The first scan signal output unit 211 includes a first pull-up transistor M1, a first pull-down transistor M6, and a first capacitor C1. The first pull-up transistor M1 includes a gate electrode connected to a first control node Q, a first electrode connected to a first scan clock input terminal SCCT1, and a second electrode connected to a first scan output terminal SC1. The first pull-down transistor M6. includes a gate electrode connected to a second control node Qb, a first electrode connected to a first off-voltage terminal VST1, and a second electrode connected to a first scan output terminal SC1. The first capacitor C1 includes a first electrode connected to a first control node Q and a second electrode connected to a first scan output terminal SC1.

The first scan signal output unit 211 outputs a scan clock signal as a scan signal through the first scan output terminal SC1 in synchronization with, or based on, the scan clock signal input to the first scan clock input terminal SCCT1 when the first control node Q is charged with an on voltage by the signal input to the first input terminal IN1. In this instance, the voltage at the first control node Q may be bootstrapped by the first capacitor C1.

The first sensing signal output unit 212 includes a second pull-up transistor M2, a second pull-down transistor M7, and a second capacitor C2. The second pull-up transistor M2 includes a gate electrode connected to a first control node Q, a first electrode connected to a first sensing clock input terminal SSCT1, and a second electrode connected to a first sensing output terminal SS1. The second pull-down transistor M7 includes a gate electrode connected to a second control node Qb, a first electrode connected to a first off-voltage terminal VST1, and a second electrode connected to a first sensing output terminal SS1. The second capacitor C2 includes a first electrode connected to a first control node Q, and a second electrode connected to a first sensing output terminal SS1.

The first sensing signal output unit 212 outputs a sensing clock signal as a sensing signal through the first sensing output terminal SS1 in synchronization with, or based on, the sensing clock signal input to the first sensing clock input terminal SSCT1 when the first control node Q is charged with the on voltage by the signal input to the first input terminal IN1. In this instance, the voltage at the first control node Q may be bootstrapped by the second capacitor C2.

The second scan signal output unit 213 includes a third pull-up transistor M3, a third pull-down transistor M8, and a third capacitor C3. The third pull-up transistor M3 includes a gate electrode connected to a first control node Q, a first electrode connected to a second scan clock input terminal SCCT2, and a second electrode connected to a second scan output terminal SC2. The third pull-down transistor M8 includes a gate electrode connected to a second control node Qb, a first electrode connected to a first off-voltage terminal VST1, and a second electrode connected to a second scan output terminal SC2. The third capacitor C3 includes a first electrode connected to a first control node Q and a second electrode connected to a second scan output terminal SC2.

The second scan signal output unit 213 outputs a scan clock signal as a scan signal through the second scan output terminal SC2 in synchronization with, or based on, the scan clock signal input to the second scan clock input terminal SCCT2 when the first control node Q is charged with the on voltage by the signal input to the first input terminal IN1. In this instance, the voltage at the first control node Q may be bootstrapped by the third capacitor C3.

The second sensing signal output unit 214 includes a fourth pull-up transistor M4, a fourth pull-down transistor M9, and a fourth capacitor C4. The fourth pull-up transistor M4 includes a gate electrode connected to a first control node Q, a first electrode connected to a second sensing clock input terminal SSCT2, and a second electrode connected to a second sensing output terminal SS2. The fourth pull-down transistor M9 includes a gate electrode connected to a second control node Qb, a first electrode connected to a first off-voltage terminal VST1, and a second electrode connected to a second sensing output terminal SS2. The fourth capacitor C4 includes a first electrode connected to a first control node Q and a second electrode connected to a second sensing output terminal SS2.

The second sensing signal output unit 214 outputs a sensing clock signal as a sensing signal through the second sensing output terminal SS2 in synchronization with, or based on, the sensing clock signal input to the second sensing clock input terminal SSCT2 when the first control node Q is charged with the on voltage by the signal input to the first input terminal IN1. In this instance, the voltage at the first control node Q is bootstrapped by the fourth capacitor C4.

The carry signal output unit 215 includes a fifth pull-up transistor M5 and a fifth pull-down transistor M10. The fifth pull-up transistor M5 includes a gate electrode connected to a first control node Q, a first electrode connected to a carry clock input terminal CRCT, and a second electrode connected to a carry output terminal CR. The fifth pull-down transistor M10 includes a gate electrode connected to a second control node Qb, a first electrode connected to a second off-voltage terminal VST2, and a second electrode connected to a carry output terminal CR.

The carry signal output unit 215 outputs a carry clock signal as a carry signal through the carry output terminal CR in synchronization with, or based on, the carry clock signal input to the carry clock input terminal CRCT when the first control node Q is charged with the on voltage by the signal input to the first input terminal IN1.

The pull-up controller 216 includes a first input control transistor M11. The first input control transistor M11 includes a gate electrode connected to a first input terminal IN1, a first electrode connected to a first input terminal IN1, and a second electrode connected to a first control node Q. The pull-up controller 216 transmits the signal (a carry signal at a previous stage) with an on voltage input to the first input terminal IN1 to the first control node Q.

The pull-down controller 217 includes a second input control transistor M12. The second input control transistor M12 includes a gate electrode connected to a second input terminal IN2, a first electrode connected to a second off-voltage terminal VST2, and a second electrode connected to a first control node Q. The pull-down controller 217 transmits a second off voltage VSS2 applied to a second off-voltage terminal VST2 to the first control node Q corresponding to a signal (a carry signal at the stage after next) with an on voltage input to the second input terminal IN2.

The control node stabilizer 218 includes a first stabilizing transistor M13, a second stabilizing transistor M14, and a third stabilizing transistor M15. The first stabilizing transistor M13 includes a gate electrode connected to a first input terminal IN1, a first electrode connected to a second off-voltage terminal VST2, and a second electrode connected to a second control node Qb. The first stabilizing transistor M13 transmits a second off voltage VSS2 applied to the second off-voltage terminal VST2 to the second control node Qb corresponding to a signal with an on voltage input to the first input terminal IN1. The second stabilizing transistor M14 includes a gate electrode connected to a first control node Q, a first electrode connected to a second off-voltage terminal VST2, and a second electrode connected to a second control node Qb. The second stabilizing transistor M14 transmits a second off voltage VSS2 applied to a second off-voltage terminal VST2 to the second control node Qb corresponding to the voltage at the first control node Q. The third stabilizing transistor M15 includes a gate electrode connected to a second control node Qb, a first electrode connected to a second off-voltage terminal VST2, and a second electrode connected to a first control node Q. The third stabilizing transistor M15 transmits a second off voltage VSS2 applied to a second off-voltage terminal VST2 to the first control node Q corresponding to the voltage at the second control node Qb.

The on voltage provider 219 includes an on voltage transistor M16. The on voltage transistor M16 includes a gate electrode connected to an on-voltage terminal VDT, a first electrode connected to the on-voltage terminal VDT, and a second electrode connected to the second control node Qb. The on voltage provider 219 provides an on voltage VDD applied to the on-voltage terminal VDT to the second control node Qb through the diode-connected on voltage transistor M16.

The reset unit 220 includes a reset transistor M17. The reset transistor M17 includes a gate electrode connected to a reset terminal RST, a first electrode connected to a second off-voltage terminal VST2, and a second electrode connected to a first control node Q. The reset unit 220 resets the first control node Q to be a second off voltage VSS2 corresponding to the reset signal VRST with an on voltage applied to the reset terminal RST.

The first off voltage VSS1 applied to the first off-voltage terminal VST1 is transmitted to the first scan output terminal SC1, the first sensing output terminal SS1, the second scan output terminal SC2, and the second sensing output terminal SS2, and becomes off voltages of the scan signal and the sensing signal.

The second off voltage VSS2 applied to the second off-voltage terminal VST2 is transmitted to the carry output terminal CR through a fifth pull-down transistor M10 and becomes an off voltage of the carry signal. The second off voltage VSS2 may be used to reset the first control node Q and the second control node Qb with an off voltage. The scan signal and the sensing signal may be stably output by separating the first off voltage VSS1 used for outputting of the scan signal and the sensing signal, and the second off voltage VSS2 used for resetting of the first and second control nodes Q and Qb.

The first scan signal output unit 211, the first sensing signal output unit 212, the second scan signal output unit 213, the second sensing signal output unit 214, and the carry signal output unit 215, the pull-up controller 216, the pull-down controller 217, the control node stabilizer 218, the on voltage provider 219, and the reset unit 220 are used in common for the outputting of two scan signals and two sensing signals. Accordingly, compared to the case in which one gate driving circuit is formed for each scan line, the number and the area of the gate driving circuits may be reduced, and the dead space of the display device may be reduced.

In the above, a plurality of transistors M1 to M17 included in the gate driving circuit block 210_*k* may be n-channel electric field effect transistors. According to an embodiment, at least one of a plurality of transistors M1 to M17 may be an n-channel electric field effect transistor. For the embodiment described below, a plurality of transistors M1 to M17 are n-channel electric field effect transistors.

Figure 6:
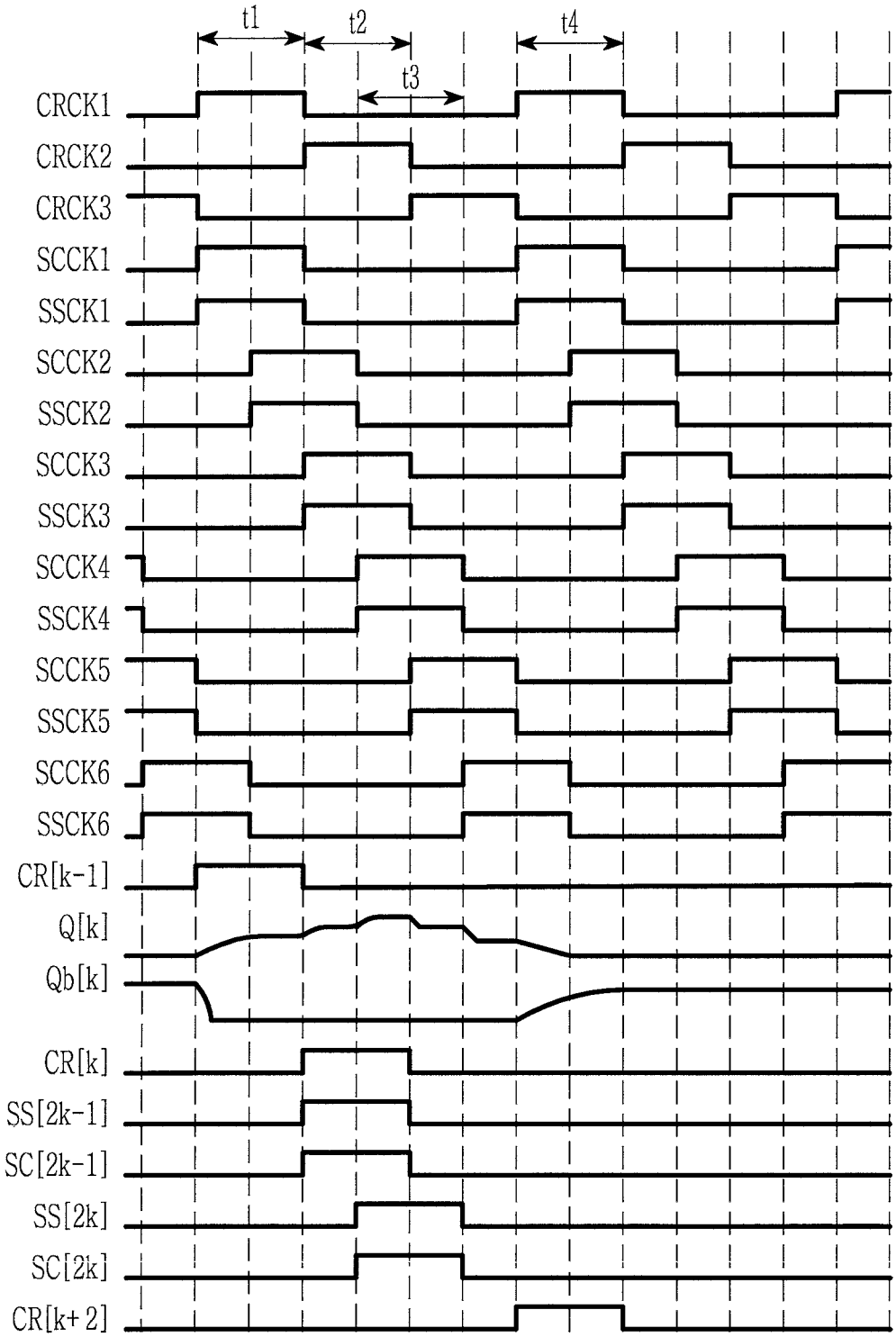
FIG. 6 shows a timing diagram of a method for driving a display device according to an embodiment of the present disclosure.

FIG. 6 shows a timing diagram of a method for driving a display device according to an embodiment of the present disclosure. A case in which the gate driving circuit block 210_*k* of FIG. 5 is provided on a position of the multiple of 3, plus 2, will now be exemplified (e.g., k is equal to one of 2, 5, 8, 11, etc.).

Referring to FIG. 5 and FIG. 6, a second carry clock signal CRCK2, a third scan clock signal SCCK3, a fourth scan clock signal SCCK4, a third sensing clock signal SSCK3, and a fourth sensing clock signal SSCK4 are input to the gate driving circuit block 210_*k* provided on the position of the multiple of 3, plus 2.

For a first period t1, a carry signal with a high level voltage output by the gate driving circuit block at the previous stage output in synchronization with, or based on, the first carry clock signal CRCK1 is input to the first input terminal IN1 of the gate driving circuit block 210_*k*. A voltage Q[k] at the first control node is pre-charged with a high-level voltage by the carry signal at the previous stage, and the first to fifth pull-up transistors M1, M2, M3, M4, and M5 are turned on by the voltage Q[k] at the first control node. In this instance, a second off voltage VSS2 is transmitted to the second control node Qb through a first stabilizing transistor M13 and through a second stabilizing transistor M14, and the voltage Qb[k] at the second control node becomes the second off voltage VSS2.

For a second period t2, a second carry clock signal CRCK2, a third scan clock signal SCCK3, and a third sensing clock signal SSCK3 are applied as high level voltages. When the third scan clock signal SCCK3 and the third sensing clock signal SSCK3 are changed to high level voltages from low level voltages, the voltage at the first control node Q is bootstrapped by the first capacitor C1 and the second capacitor C2. The third scan clock signal SCCK3 is output as a scan signal SC[2*k*−1] of a (2*k*−1)-th scan line through the first scan output terminal SC1. The third sensing clock signal SSCK3 is output as a sensing signal SS[2*k*−1] of a (2*k*−1)-th sensing line through the first sensing output terminal SS1. The second carry clock signal CRCK2 is output as a carry signal CR[k] through the carry output terminal CR.

For a third period t3, a fourth scan clock signal SCCK4 and a fourth sensing clock signal SSCK4 are applied as high level voltages. The third period t3 may partly overlap the second period t2. For example, the third period t3 may overlap the second period t2 by half of the third period t3. The fourth scan clock signal SCCK4 is output as a scan signal SC[2*k*] of a 2*k*-th scan line through the second scan output terminal SC2. The fourth sensing clock signal SSCK4 is output as a sensing signal SS[2*k*] of a 2*k*-th sensing line through the second sensing output terminal SS2. When the fourth scan clock signal SCCK4 and the fourth sensing clock signal SSCK4 are changed to high level voltages from low level voltages, the voltage at the first control node Q is bootstrapped once more by the third capacitor C3 and the fourth capacitor C4. The voltage at the first control node Q may be the highest for a period in which the second period t2 overlaps the third period t3. As the voltage at the first control node Q is bootstrapped in a double way, noise tolerance of the gate driving circuit block 210_*k* may be further improved. Further, as the voltage at the first control node Q is doubly bootstrapped, the voltage at the first control node Q may be increased to a desired level when sizes of the capacitors C1, C2, C3, and C4 for outputting the scan signal and the sensing signal are reduced, so the sizes of the capacitors C1, C2, C3, and C4 may be formed to be relatively small.

In another way, the second carry clock signal CRCK2 input to the carry clock input terminal CRCT may be applied as a high level voltage for a time when the voltage at the first control node Q is doubly bootstrapped in the second period t2 and the third period t3. In other words, periods of the carry clock signals CRCK1, CRCK2, and CRCK3 may be controlled so that they may be applied as high level voltages while scan signals corresponding to two different scan lines (or pixel rows) are output.

When the second period t2 is finished, the third scan clock signal SCCK3 and the third sensing clock signal SSCK3 are changed to low level voltages. When the third period t3 is finished, the fourth scan clock signal SCCK4 and the fourth sensing clock signal SSCK4 are changed to low level voltages. Accordingly, the voltage at the first control node Q may be gradually lowered.

For a fourth period t4, the carry signal CR[k+2] at a high level of the gate driving circuit block at the stage after next is input to the second input terminal IN2. A second input control transistor M12 is turned on by the carry signal CR[k+2] input to the second input terminal IN2, and the first control node Q is reset with the second off voltage VSS2. As the first control node Q is reset with the second off voltage VSS2, the first to fifth pull-up transistors M1, M2, M3, M4, and M5 are turned off. Corresponding to the voltage at the first control node Q, the second stabilizing transistor M14 is turned off, and the second control node Qb is reset with the on voltage VDD provided through the on voltage transistor M16. As the second control node Qb is reset with the on voltage VDD, the first to fifth pull-down transistors M6, M7, M8, M9, and M10 are turned on. In this instance, a third stabilizing transistor M15 is turned on corresponding to the on voltage VDD of the second control node Qb, and the voltage at the first control node Q is maintained at the second off voltage VSS2. As described, as the carry signal CR[k+2] at a high level of the gate driving circuit block at the stage after next is input to the second input terminal IN2, the first control node Q may be reset with the second off voltage VSS2, and the second control node Qb may be reset with the on voltage VDD.

In another way, FIG. 6 does not exemplify the reset signal VRST input to the reset terminal RST, but the reset signal VRST may be concurrently or simultaneously input to a plurality of gate driving circuit blocks, so when the reset signal VRST is applied as a high level voltage, the first control node Q and the second control node Qb of a plurality of gate driving circuit blocks may be concurrently or simultaneously reset with the second off voltage VSS2 and the on voltage VDD, respectively.

The accompanying drawings and the embodiments of the present disclosure are only examples of the present disclosure, and are used to describe the present disclosure but do not limit the scope of the present disclosure as defined by the following claims. Thus, it will be understood by those of ordinary skill in the art that various modifications and equivalent embodiments may be made. Therefore, the technical scope of the present disclosure may be defined by the technical idea of the following claims, with functional equivalents thereof to be included.

What is claimed is:

1. A display device comprising:

a plurality of pixels;

a gate driver for applying a scan signal to a plurality of scan lines connected to the pixels, and comprising a plurality of gate driving circuit blocks; and a data driver for applying a data voltage to a plurality of data lines connected to the pixels, wherein the gate driving circuit blocks respectively:

output a carry signal to be transmitted to a first input terminal of a subsequent gate driving circuit block at a next stage based on both a signal applied to a first control node through a first input terminal and a carry clock signal input to a carry clock input terminal;

output a first scan signal to a first scan line based on both the signal applied to the first control node and a first scan clock signal input to a first scan clock input terminal; and output a second scan signal to a second scan line based on the signal applied to the first control node and a second scan clock signal input to a second scan clock input terminal, and wherein a total number of scan clock signals and sensing clock signals used in an operation of the gate driver corresponds to a product of a number of scan signals and sensing signals output by the gate driving circuit blocks and a total number of carry clock signals used in an operation of the gate driver.

2. The display device of claim 1, wherein the gate driving circuit blocks are respectively configured to bootstrap a voltage of the signal applied to the first control node through the first input terminal by using a first scan clock signal input to the first scan clock input terminal, and to bootstrap the voltage of the signal applied to the first control node through the first input terminal by using a second scan clock signal input to the second scan clock input terminal.

3. The display device of claim 2, wherein the gate driving circuit blocks are respectively configured to not bootstrap a voltage at the first control node with the carry clock signal, and are configured to output the carry clock signal as the carry signal.

4. The display device of claim 3, wherein the carry clock signal is configured to be applied as an on voltage while a voltage at a first node is bootstrapped.

5. The display device of claim 1, wherein the gate driver is configured to apply a sensing signal for measuring a current flowing to the pixels to a sensing line connected to the pixels, and wherein the gate driving circuit blocks are respectively configured to output a sensing signal to a first sensing line based on a sensing clock signal input to a first sensing clock input terminal, and to output a sensing signal to a second sensing line based on a sensing clock signal input to a second sensing clock input terminal.

6. The display device of claim 5, wherein the gate driving circuit blocks are respectively configured to bootstrap a voltage of the signal applied to the first control node through the first input terminal by using a first sensing clock signal input to the first sensing clock input terminal, and to bootstrap the voltage of the signal applied to the first control node through the first input terminal by using a second sensing clock signal input to the second sensing clock input terminal.

7. The display device of claim 1, wherein a voltage level of a gate-on voltage of the carry clock signal is different from a voltage level of a gate-on voltage of a first scan clock signal input to the first scan clock input terminal or is different from a voltage level of gate-on voltage of a second scan clock signal input to the second scan clock input terminal.

8. The display device of claim 1, wherein a number of the gate driving circuit blocks is half a number of the scan lines.

9. A gate driving circuit comprising:

a carry signal output unit for outputting a carry signal to be transmitted to a first input terminal of a subsequent gate driving circuit at a next stage based on both a signal applied to a first control node through a first input terminal and a carry clock signal input to a carry clock input terminal;

a first scan signal output unit for outputting a first scan signal to a first scan line based on both the signal applied to the first control node and a first scan clock signal input to a first scan clock input terminal; and a second scan signal output unit for outputting a second scan signal to a second scan line based on both the signal applied to the first control node and a second scan clock signal input to a second scan clock input terminal, wherein a total number of scan clock signals and sensing clock signals used in an operation of a gate driver, which comprises a plurality of gate driving circuits including the gate driving circuit, corresponds to a value of a product of a number of scan signals and sensing signals output by the plurality of gate driving circuits and a total number of carry clock signals used in an operation of the gate driver.

10. The gate driving circuit of claim 9, wherein the first scan signal output unit comprises:

a first pull-up transistor comprising a gate electrode connected to the first control node, a first electrode connected to the first scan clock input terminal, and a second electrode connected to a first scan output terminal connected to the first scan line; and a first capacitor comprising a first electrode connected to the first control node and a second electrode connected to the first scan output terminal.

11. The gate driving circuit of claim 10, wherein the second scan signal output unit comprises:

a third pull-up transistor comprising a gate electrode connected to the first control node, a first electrode connected to the second scan clock input terminal, and a second electrode connected to a second scan output terminal connected to the second scan line; and a third capacitor comprising a first electrode connected to the first control node and a second electrode connected to the second scan output terminal.

12. The gate driving circuit of claim 11, wherein the carry signal output unit comprises a fifth pull-up transistor comprising a gate electrode connected to the first control node, a first electrode connected to the carry clock input terminal, and a second electrode connected to a carry output terminal connected to a first input terminal of the subsequent gate driving circuit at the next stage.

13. The gate driving circuit of claim 9, further comprising:

a first sensing signal output unit for outputting a first sensing signal to a first sensing line based on the signal applied to the first control node and a first sensing clock signal input to a first sensing clock input terminal; and a second sensing signal output unit for outputting a second sensing signal to a second sensing line based on the signal applied to the first control node and a second sensing clock signal input to a second sensing clock input terminal.

14. The gate driving circuit of claim 13, wherein the first sensing signal output unit comprises:

a second pull-up transistor comprising a gate electrode connected to the first control node, a first electrode connected to the first sensing clock input terminal, and a second electrode connected to a first sensing output terminal connected to the first sensing line; and a second capacitor comprising a first electrode connected to the first control node, and a second electrode connected to the first sensing output terminal.

15. The gate driving circuit of claim 14, wherein the second sensing signal output unit comprises:

a fourth pull-up transistor comprising a gate electrode connected to the first control node, a first electrode connected to the second sensing clock input terminal, and a second electrode connected to a second sensing output terminal connected to the second sensing line; and a fourth capacitor comprising a first electrode connected to the first control node, and a second electrode connected to the second sensing output terminal.

16. A method for driving a display device comprising a gate driver for applying a scan signal to a plurality of scan lines connected to a plurality of pixels, the gate driver comprising a plurality of gate driving circuit blocks, the method comprising:

applying a first carry signal output by a previous gate driving circuit block at a previous stage to a first control node through a first input terminal to precharge the first control node;

outputting a second carry signal to be transmitted to a first input terminal of a subsequent gate driving circuit block at a next stage based on a carry clock signal input to a carry clock input terminal by a voltage at the first control node;

outputting a first scan signal to a first scan line based on a first scan clock signal input to a first scan clock input terminal by a voltage at the first control node; and outputting a second scan signal to a second scan line based on a second scan clock signal input to a second scan clock input terminal by a voltage at the first control node, wherein a total number of scan clock signals and sensing clock signals used in an operation of the gate driver corresponds to a value of a product of a number of scan signals and sensing signals output by the gate driving circuit blocks and a total number of carry clock signals used in an operation of the gate driver.

17. The method of claim 16, further comprising bootstrapping a voltage at the first control node by a first scan clock signal input to the first scan clock input terminal; and bootstrapping a voltage at the first control node by a second scan clock signal input to the second scan clock input terminal.

18. The method of claim 17, wherein a first period for outputting a first scan signal to the first scan line partly overlaps a second period for outputting a second scan signal to the second scan line.

19. The method of claim 16, further comprising:

outputting a first sensing signal to a first sensing line based on a first sensing clock signal input to a first sensing clock input terminal by a voltage at the first control node; and outputting a second sensing signal to a second sensing line based on a second sensing clock signal input to a second sensing clock input terminal by a voltage at the first control node.

* * * * *